US005940658A

United States Patent [19]

Yokoi et al.

[11] Patent Number: 5,940,658

[45] Date of Patent: Aug. 17, 1999

[54] TONER FRAME AND PROCESS CARTRIDGE

[75] Inventors: Akiyoshi Yokoi; Minoru Sato; Yoshiyuki Batori, all of Toride, Japan

[73] Assignee: Canon Kabushiki Kaisha, Tokyo, Japan

[21] Appl. No.: 09/054,464

[22] Filed: Apr. 3, 1998

[30] Foreign Application Priority Data

Apr. 7, 1997 [JP] Japan ..... 9-103947
Mar. 24, 1998 [JP] Japan ..... 10-075494

[51] Int. Cl.[6] ..... G03G 15/08

[52] U.S. Cl. ..... 399/119; 399/111; 399/256

[58] Field of Search ..... 399/119, 111, 399/113, 254, 255, 256, 262

[56] References Cited

U.S. PATENT DOCUMENTS 5,666,618 9/1997 Lee et al. ..... 399/254
5,724,635 3/1998 Nagaoka et al. ..... 399/260
5,774,766 6/1998 Karakama et al. ..... 399/111
5,835,822 11/1998 Nagasaki et al. ..... 399/111

*Primary Examiner*—Richard Moses
*Attorney, Agent, or Firm*—Fitzpatrick, Cella, Harper & Scinto

[57] ABSTRACT

A toner frame usable with a main assembly of an electrophotographic image forming apparatus, includes (a) a toner containing portion for containing toner to be supplied to a developing member for developing a latent image formed on an electrophotographic photosensitive member; (b) a toner supply opening for supplying the toner into the toner containing portion, wherein the toner supply opening is provided in a longitudinal end portion of the toner containing portion; and (c) a supporting portion for supporting one end portion of a stirring member for stirring toner contained in the toner containing portion, wherein the supporting portion is disposed within a range of the toner supply opening and at a position deviated from a center of the toner supply opening, as seen in a longitudinal direction of the toner frame.

26 Claims, 12 Drawing Sheets

TONER FRAME AND PROCESS CARTRIDGE

FIELD OF THE INVENTION AND RELATED ART

The present invention relates to a toner container frame and a process cartridge.

A process cartridge means a cartridge which is removably installable in the main assembly of an image forming apparatus, and in which a means for developing latent images formed on an electrophotographic photosensitive member, and an electrophotographic photosensitive member, are integrally disposed. A process cartridge may be a removable cartridge which comprises an electrophotographic photosensitive member, and at least a member for charging an electrophotographic photosensitive member or a cleaning member for removing the developer which remains on the electrophotographic photosensitive member, in addition to a developing means.

An electrophotographic image forming apparatus means an apparatus which forms images on recording medium with the use of an electrophotographic image forming system. For example, electrophotographic copying machines, electrophotographic printers (laser beam printers, LED printers, and the like), facsimile machines, word processors, and the like are the typical electrophotographic image forming apparatuses.

Electrophotographic image forming apparatuses such as electrophotographic copying machines or laser beam printers comprise a photosensitive drum, which is subjected to known image forming processes, for example, charging, exposing, developing, and the like, to form toner images on a photosensitive drum The toner image formed on the photosensitive drum is transferred onto recording medium such as a sheet of transfer paper or the like. Thereafter, the toner particles which remain on the photosensitive drum are removed, or cleaned, by a cleaning device.

In recent years, in order to reduce the size of an electrophotographic image forming apparatus, and to simplify the maintenance of an image forming apparatus, process cartridge systems have become very popular. A process cartridge system means a system in which a photosensitive drum, and processing means which act on the photosensitive drum, are integrally disposed in a cartridge which can be removably installed in the main assembly of an image forming apparatus by users themselves As described above, the processing means are a charging member, a developing member, a cleaning member, and/or the likes.

The lateral walls, that is, the walls located at the longitudinal ends, of the aforementioned process cartridge are provided with a bearing which supports a toner stirring rod, and a mouth through which toner is filled into the cartridge. The stirring rod stirs and advances the toner in the process cartridge.

Positioning the toner filling mouth at the lateral end of a process cartridge makes it easier to fill toner evenly throughout the toner space of the process cartridge. Further, the larger the mouth, the better the efficiency with which toner is filled. The bearing for the toner stirring rod must be properly located in consideration of various factors. Generally, process cartridges are structured so that the location of the center of the opening of the toner filling mouth substantially coincides with the location of the center of the bearing for the toner stirring rod. More specifically, the opening of the toner filling mouth is provided with ribs, which are disposed across the opening in such a manner that they intersect with each other at the substantial center of the opening, as if they radially extend from the center of the opening, and evenly divide the opening, and the bearing is located at the intersection of the ribs.

SUMMARY OF THE INVENTION

An object of the present invention is to provide a toner space and a process cartridge, in which the members for supporting a toner stirring member, and the toner filling mouth of the toner space, are properly positioned.

Another object of the present invention is to provide a toner space, and a process cartridge, in which the members for supporting a toner stirring member are properly positioned even though the toner space is provided with a toner filling mouth with improved toner filling efficiency.

According to an aspect of the present invention, there is provided a toner frame usable with a main assembly of an electrophotographic image forming apparatus, comprising:

(a) a toner containing portion for containing toner to be supplied to a developing member for developing a latent image formed on an electrophotographic photosensitive member;

(b) a toner supply opening for supplying the toner into said toner containing portion, wherein said toner supply opening is provided in a longitudinal end portion of said toner containing portion; and (c) a supporting portion for supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described in detail with reference to the drawings. In the following embodiments of the present invention, the present invention will be described with reference to a laser beam printer. Further, in the following embodiments, the horizontal direction which is perpendicular to the direction in which a process cartridge is installed into, or removed from, an image forming apparatus, will be referred to "longitudinal direction".

Embodiment 1

Figure 1:
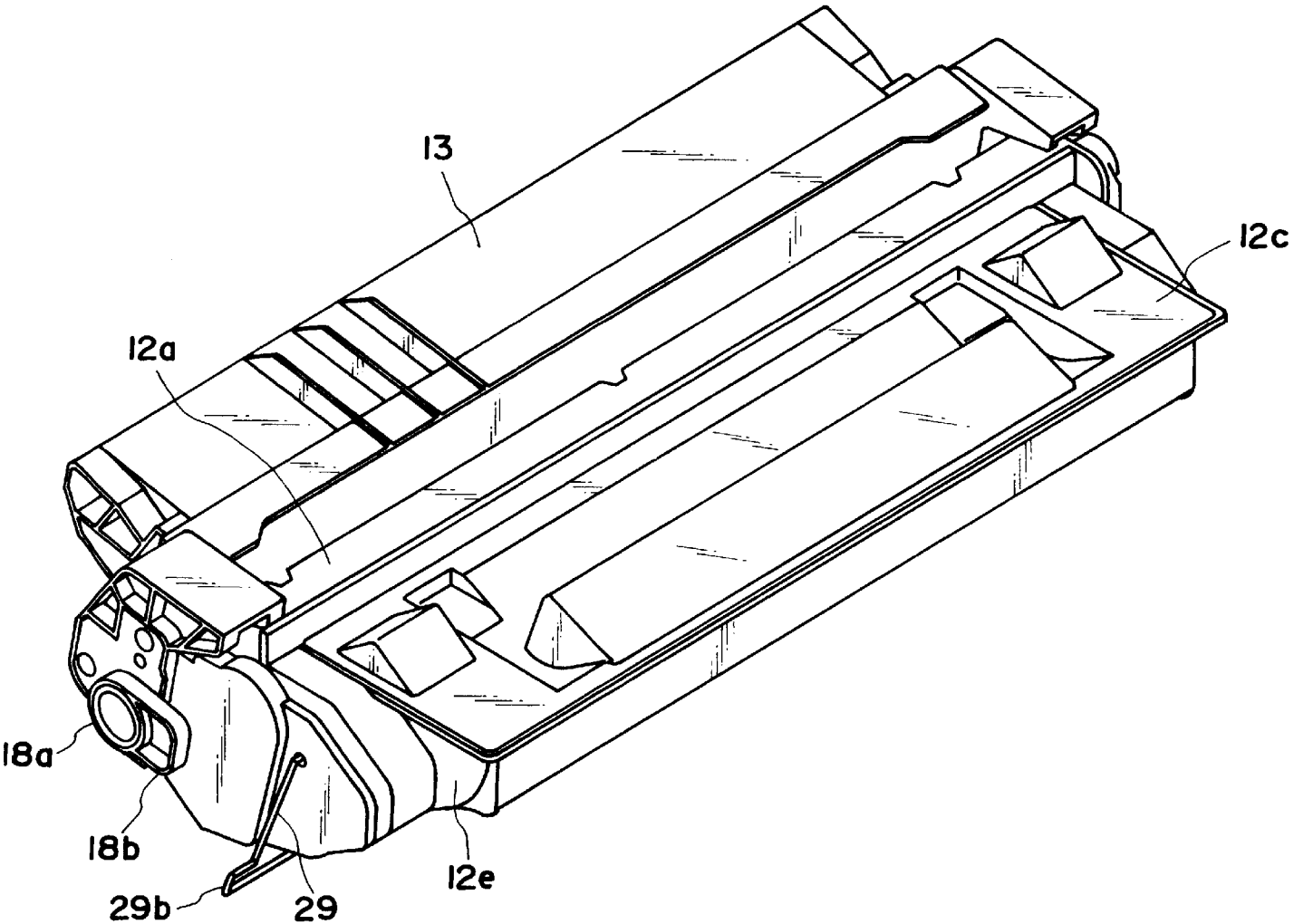
FIG. 1 is a perspective external view of the left side of a process cartridge in an embodiment of the present invention.
Figure 2:
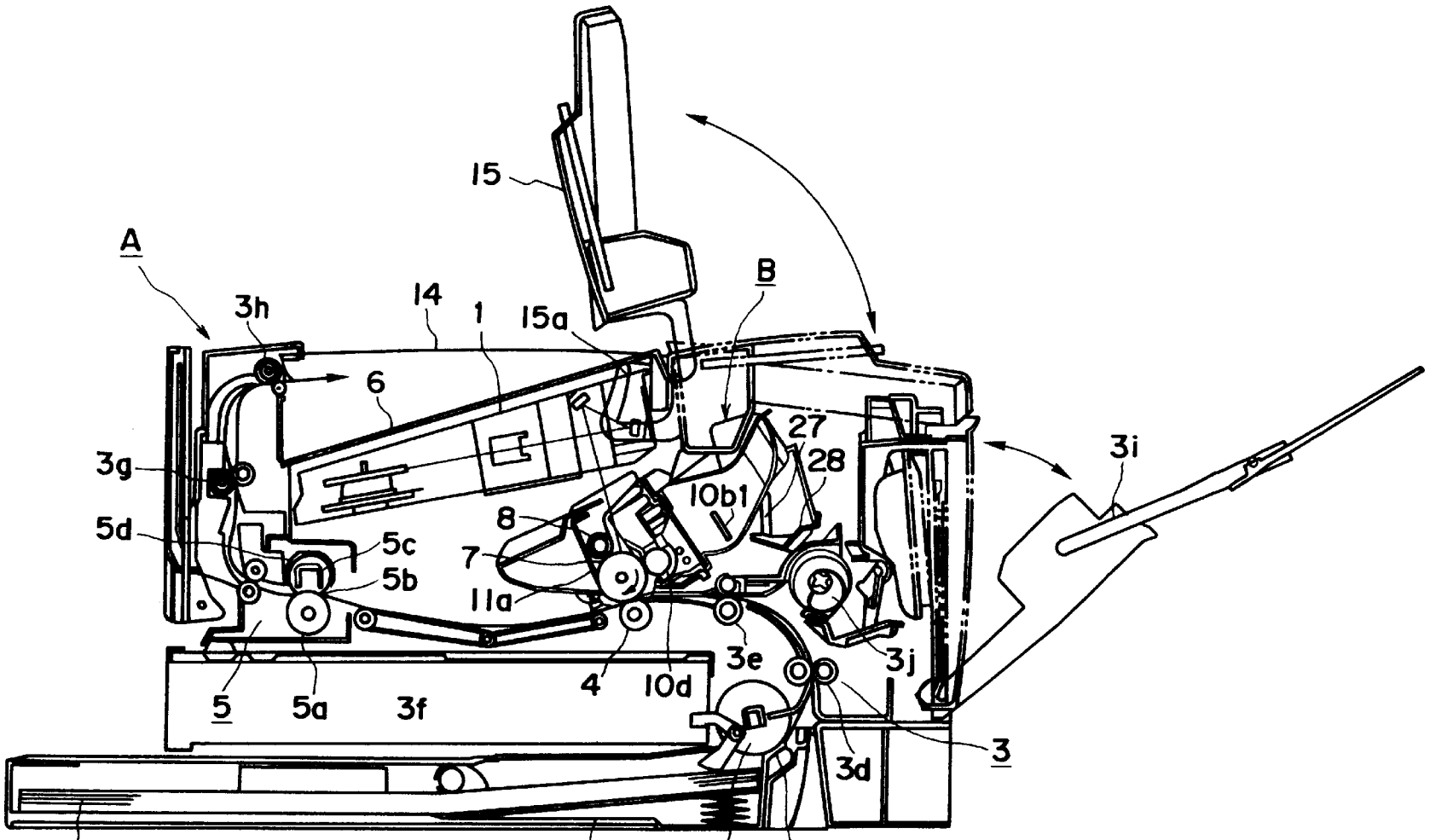
FIG. 2 is a vertical section of a typical image forming apparatus in which a typical process cartridge has been installed, depicting the structures thereof.
Figure 3:
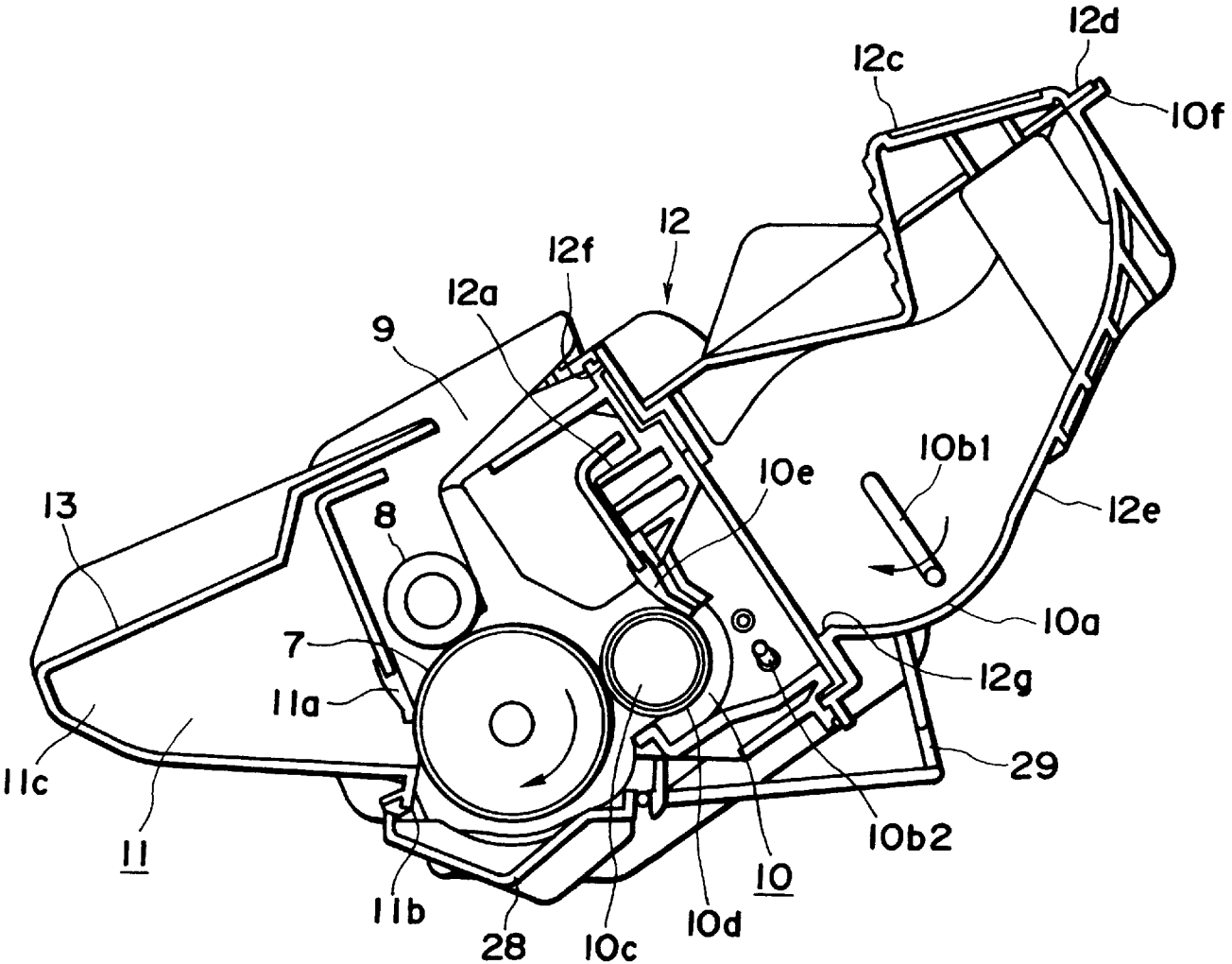
FIG. 3 is a vertical section of a process cartridge, depicting the general structure thereof.
Figure 4:
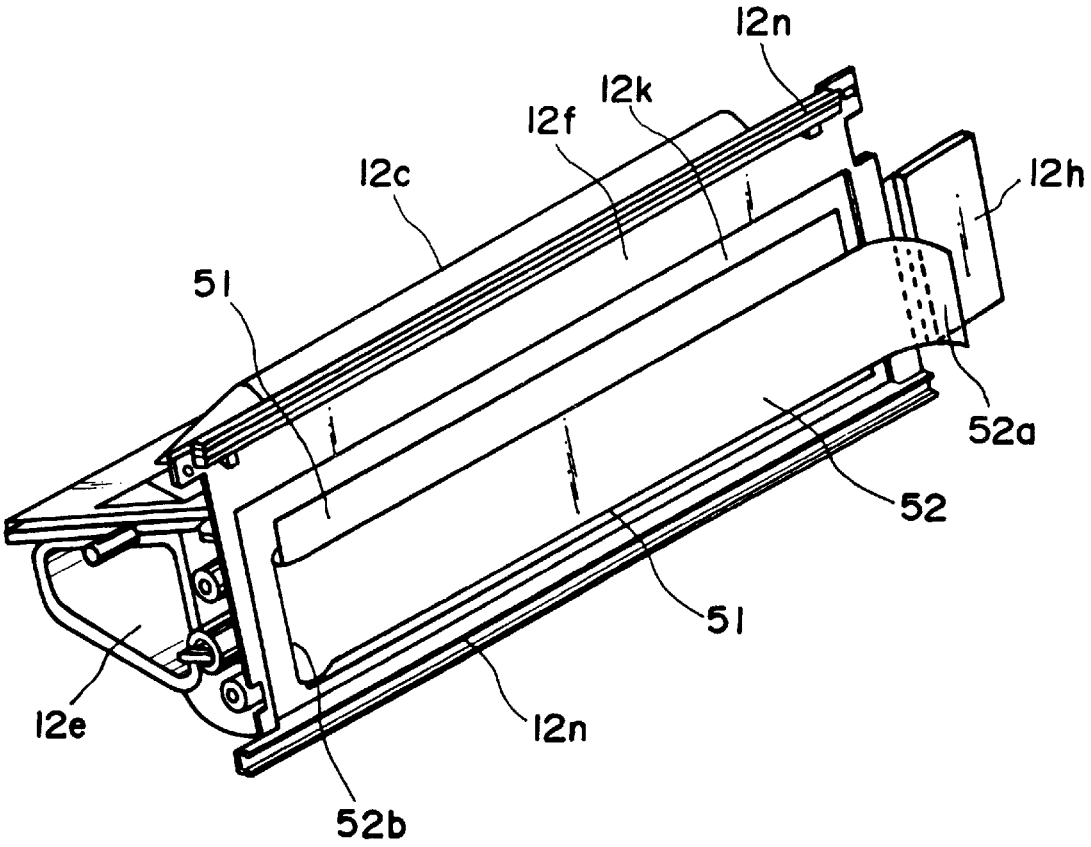
FIG. 4 is a perspective view of the toner container section of a process cartridge.
Figure 5:
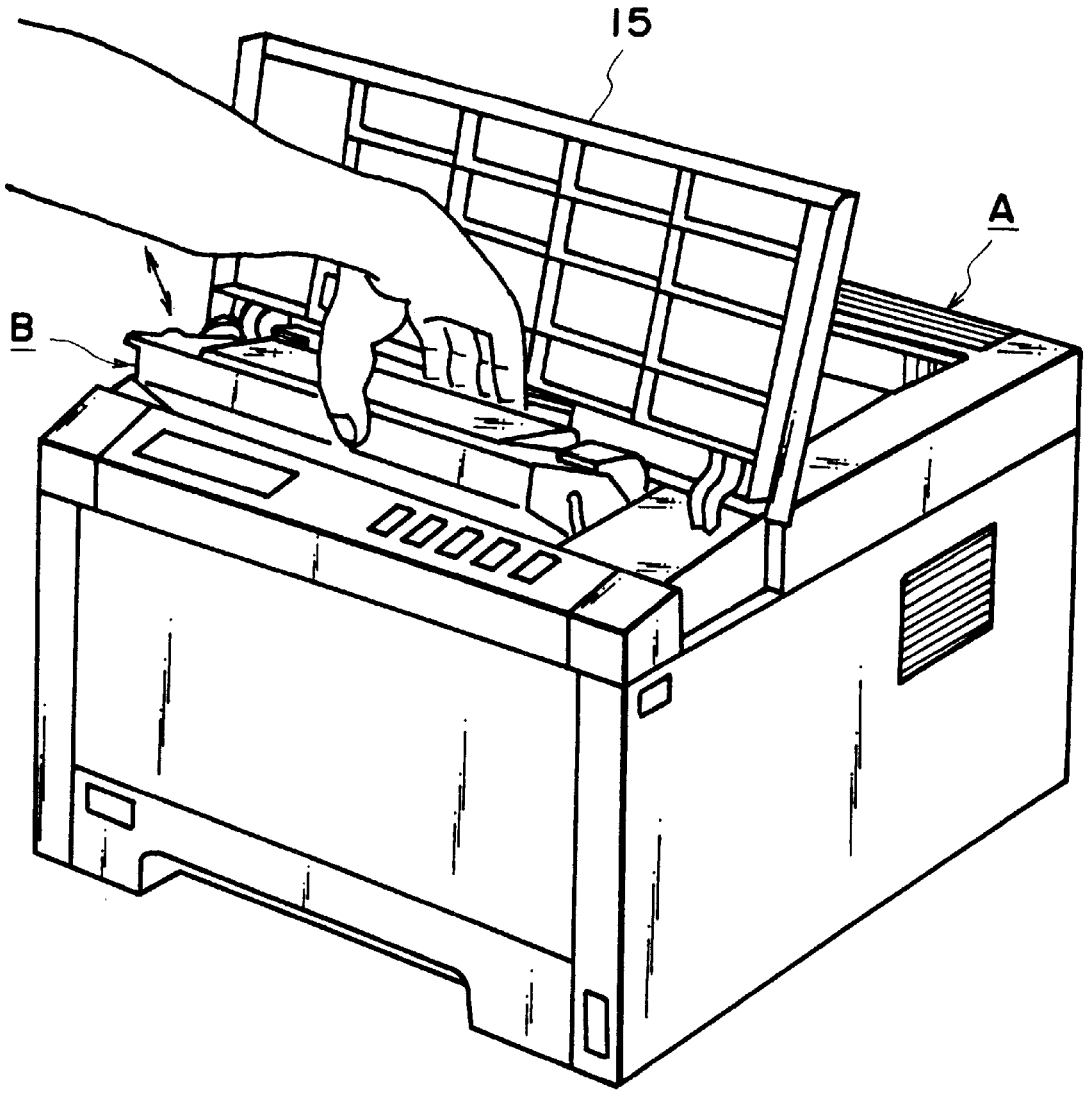
FIG. 5 is a perspective view of a typical image forming apparatus, in which a process cartridge is being installed, or from which a process cartridge is being removed.
Figure 6:
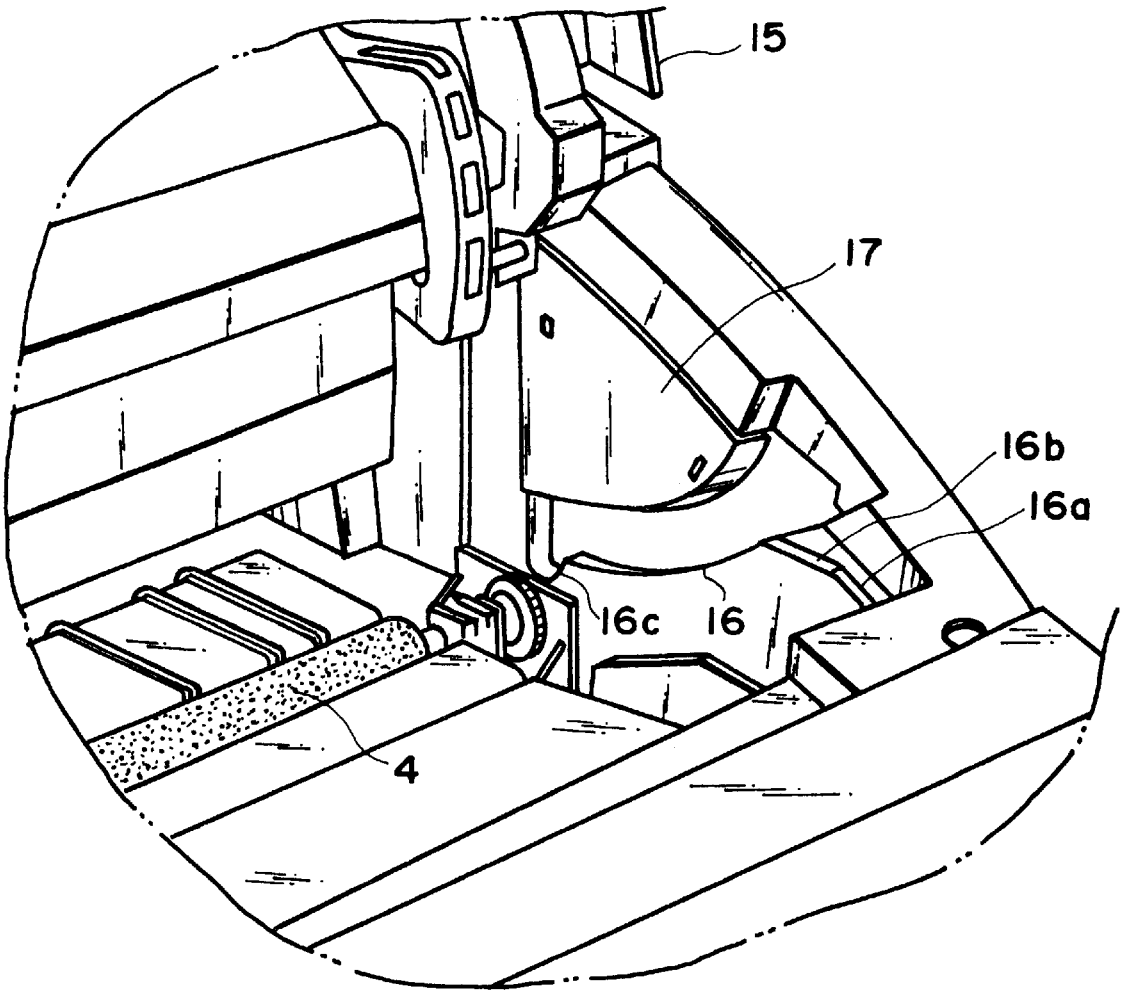
FIG. 6 is a perspective view of the inward side of the right-hand side of an image forming apparatus, depicting the right-hand guide, along which a process cartridge is installed or removed.
Figure 7:
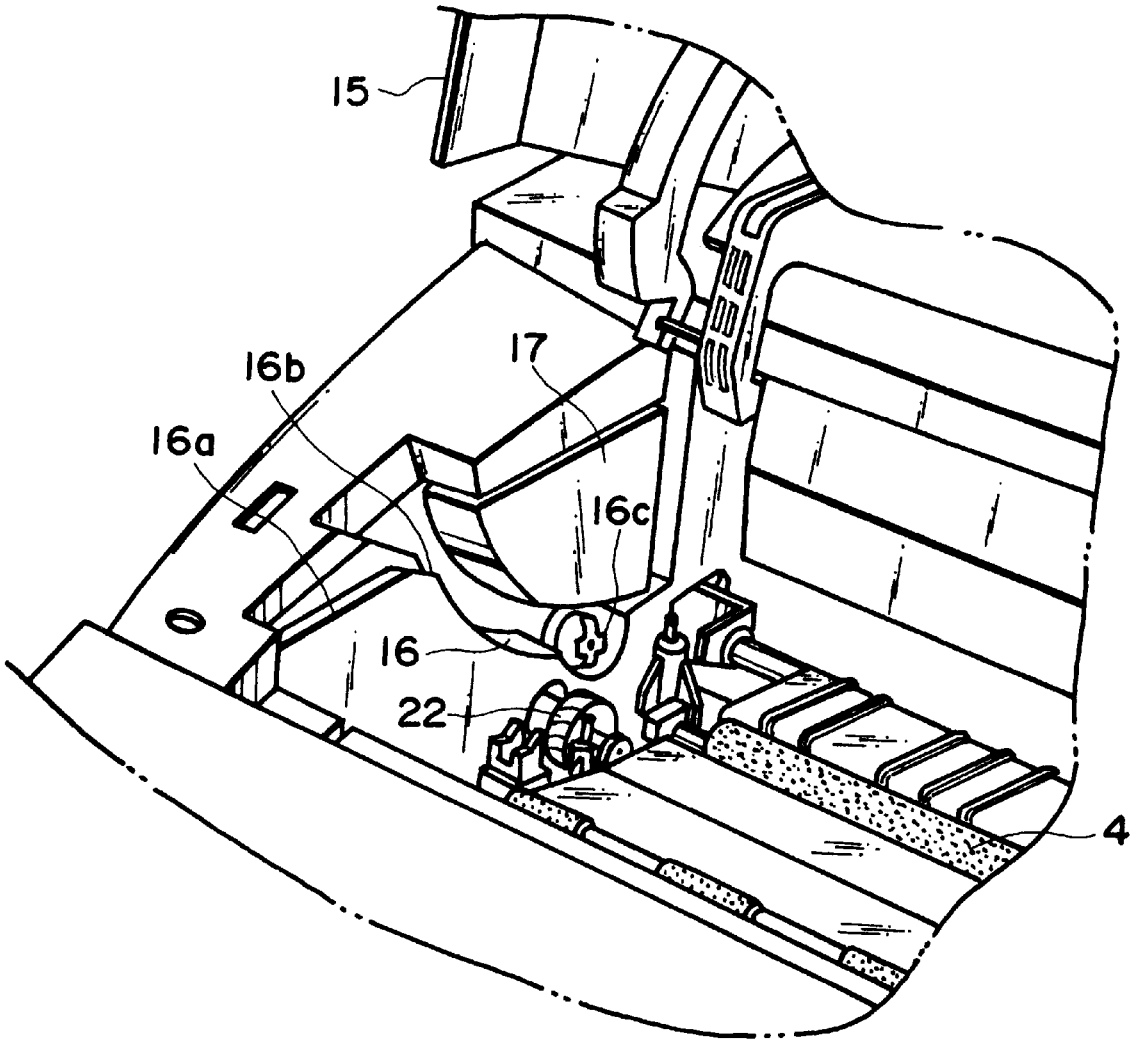
FIG. 7 is perspective view of the inward side of the left-hand side of the image forming apparatus, depicting the left-hand guide, along which a process cartridge is installed or removed.
Figure 8:
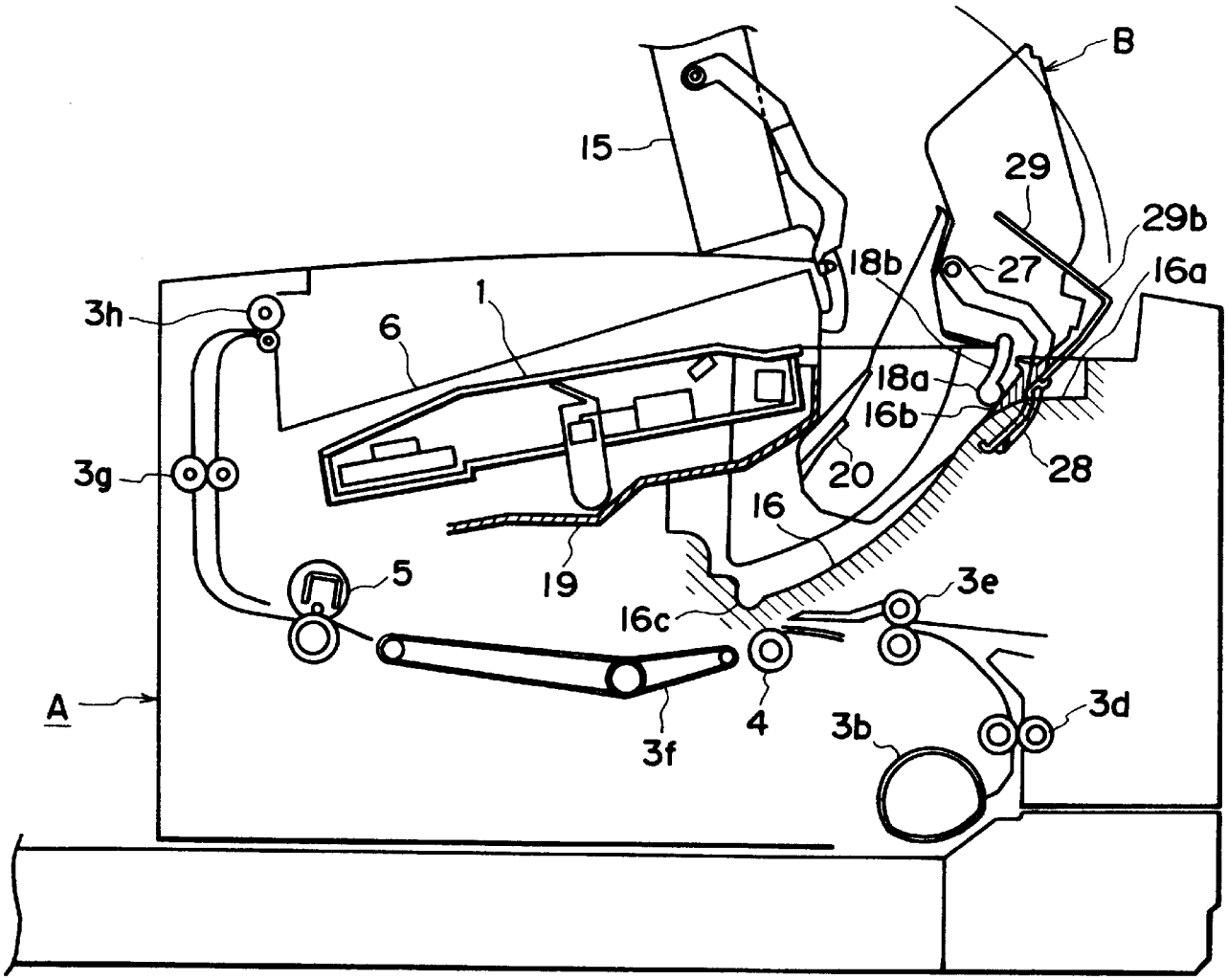
FIG. 8 is schematic section of an image forming apparatus, in which a process cartridge is being installed.
Figure 9:
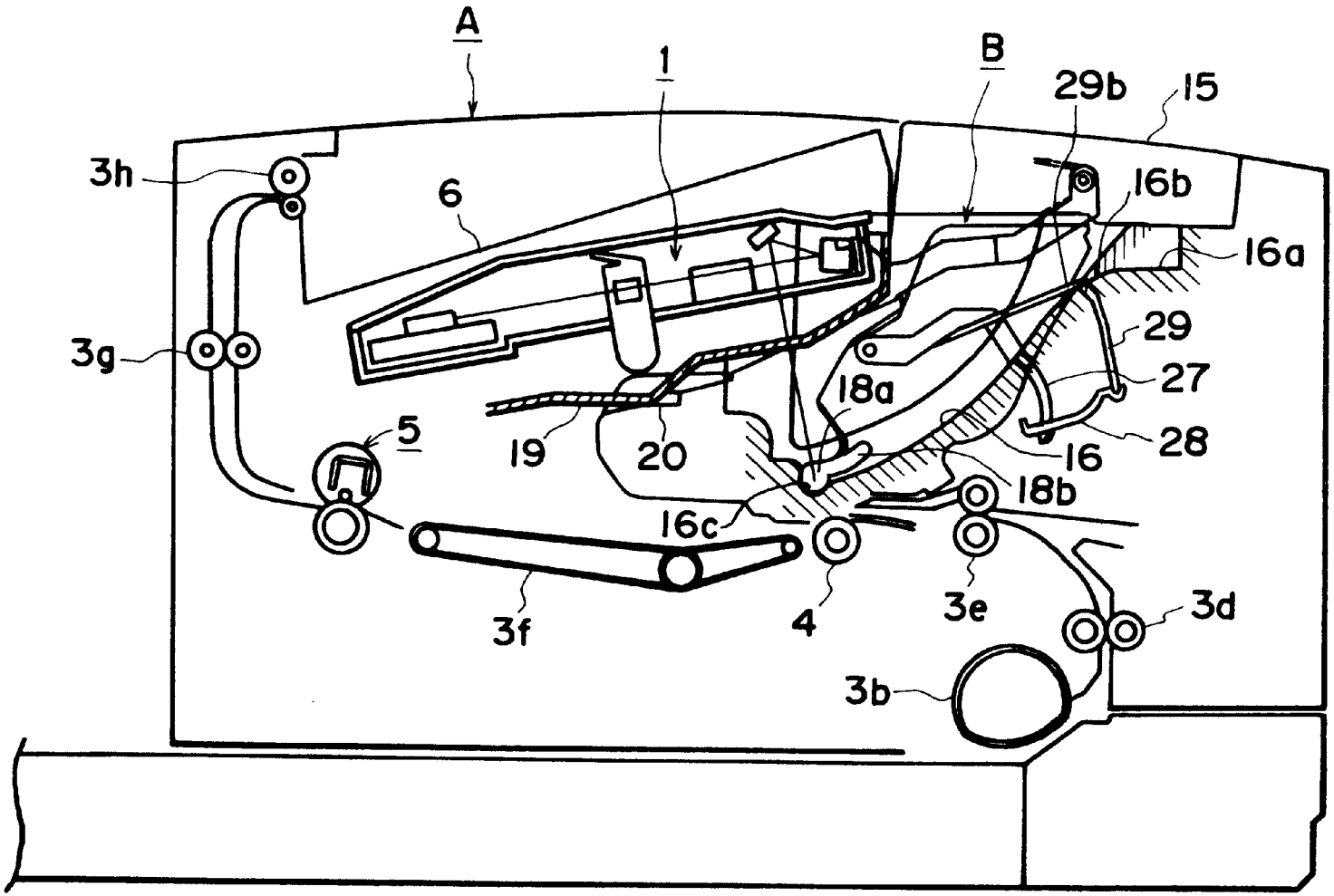
FIG. 9 is a schematic section of an image forming apparatus, in which a process cartridge is being installed.
Figure 10:
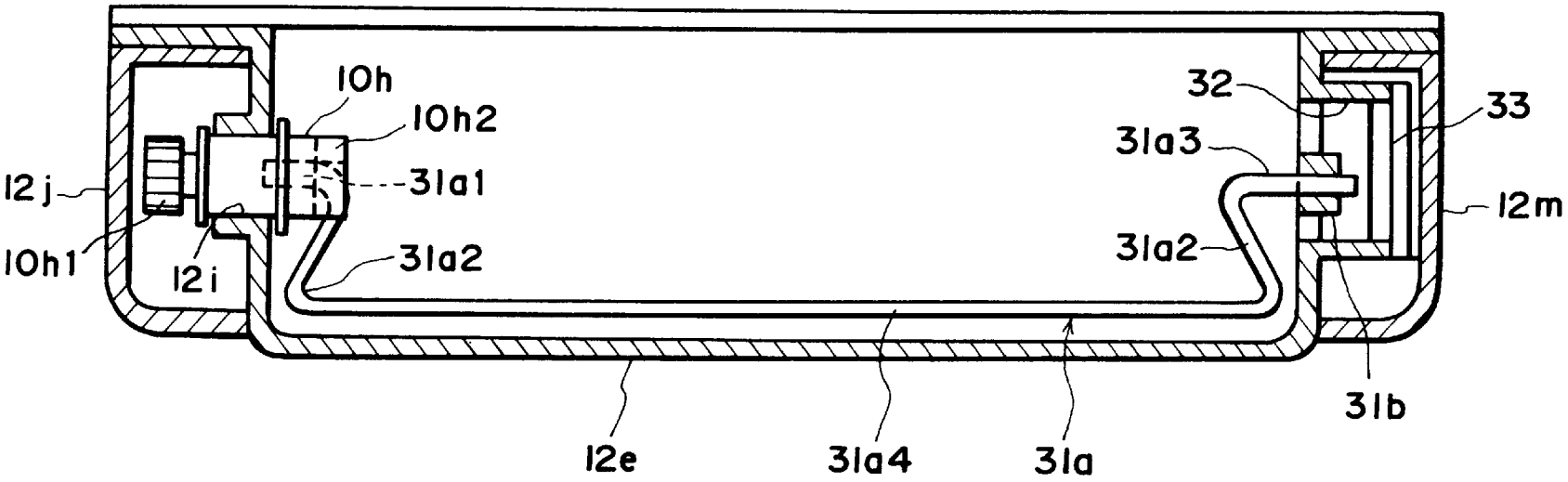
FIG. 10 is a vertical section of the toner container section of a process cartridge, parallel to the longitudinal direction of the cartridge.
Figure 11:
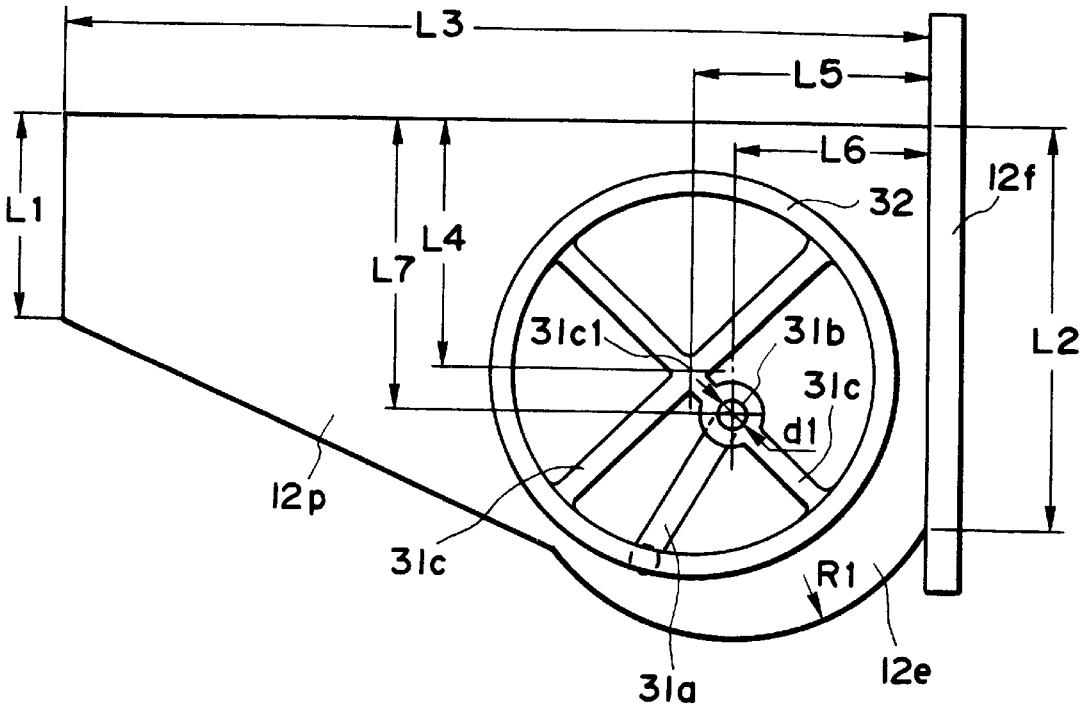
FIG. 11 is a plan view of the lateral wall of the toner container section of a process cartridge, depicting the structure of the toner filling mouth in the first embodiment of the present invention.

Referring to FIGS. 1–11, a typical process cartridge, and a typical image forming apparatus in which the process cartridge is installable, will be concretely described. FIG. 1 is a perspective external view of the process cartridge, and FIG. 2 is a schematic section of the image forming apparatus in which the process cartridge has been installed, and depicts the general structures thereof. FIG. 3 is a vertical section of the process cartridge, and depicts the general structure thereof, and FIG. 4 is a perspective view of the toner container section of the process cartridge. FIGS. 5–7 are perspective views of the entirety of the image forming apparatus, the inside of the right-hand portion of the image forming apparatus, and the inside of the left-hand portion of the image forming apparatus, which depict the structure of the means for installing the process cartridge. FIGS. 8 and 9 are schematic vertical sections of the image forming apparatus in which the process cartridge is being installed. FIG. 10 is a vertical section of the toner container frame, parallel to the longitudinal direction of the process cartridge. FIG. 11 is a plan view of the lateral wall of the toner container portion of the process cartridge, depicting the details of the present invention.

{General Structure}

In this section, a process cartridge in accordance with the present invention, and an image forming apparatus compatible with such a process cartridge, will be described in terms of their general structures.

Referring to FIG. 2, in this electrophotographic image forming apparatus (laser beam printer) A, images are formed through the following steps. First, a beam of light modulated with the optical information of a target image is projected from an optical system 1 onto the peripheral surface of the cylindrical electrophotographic photosensitive member of the image forming apparatus, forming a latent image thereon. This latent image is developed with developer (hereinafter, "toner") into a toner image. During the formation of the toner image, a sheet of recording medium 2 is separated from the rest of the sheets in a sheet feeder cassette 3*a*, and sent out of a cassette 3*a*, into the main assembly of the image forming apparatus, by a pickup roller 3*b*, and a pressing member 3*c* which is pressed upon a pickup roller 3*b*. Then, in synchronism with the conveyance of the toner image, the recording medium 2 is delivered by a conveying means 3, which is constituted of a conveyer roller pair 3*d*, a registration roller pair 3*c*, and the like, to the location of a transfer roller 4 as a means for transferring to the recording medium 2 the toner image formed on the electrophotographic photosensitive member in a process cartridge B. At the transfer roller 4, the toner image is transferred onto the recording medium 2 by applying voltage to the transfer roller 4. After receiving the toner image, the recording medium 2 is delivered to a fixing means 5 by a conveyer belt 3*f*. The fixing means 5 is constituted of a driver roller 5*a* and a cylindrical rotative member 5*d*. The cylindrical rotative member 5*d* contains a heater 5*b* and is rotatively supported by a supporting member 5*c*. As the recording medium 2 is passed through the fixing means 5, the toner image is permanently fixed to the recording medium 2 through the application of heat and pressure. After the fixation of the toner image, the recording medium 2 is conveyed through a reversing path, and then is discharged into a delivery tray 6, by discharge roller pairs 3*g* and 3*h*. In the case of this image forming apparatus A, the recording medium 2 may be manually fed with the use of a manual feeder tray 3*i* and a roller 3*j*.

{Process Cartridge}

Referring to FIG. 3, in the process cartridge B in this embodiment, a photosensitive drum 7, which is an electrophotographic photosensitive member with a photosensitive layer, is rotated, and the peripheral surface of the photosensitive drum 7 is uniformly charged by applying voltage to a charge roller 8, that is, a charging means. The charged surface of the photosensitive drum 7 is exposed to an optical image projected from the aforementioned optical system 1 through an opening 9, to form a latent image on the charged surface. The formed latent image is developed by a developing means 10.

In the developing means 10, the toner in the toner container portion 10*a* of a developer container is advanced, while being stirred, toward a development roller 10*d*, by rotating first and second toner advancing members 10*b*1 and 10*b*2, which constitute the toner advancing means. The development roller 10*d* is a cylindrical rotative member in which a stationary magnet 10*c* is fixedly disposed The toner which has advanced to the development roller 10*d* is coated, while being regulated by a development blade 10*e*, on the peripheral surface of the development roller 10*d*, forming a toner layer composed of triboelectrically charged toner particles The charged toner particles are transferred onto the peripheral surface of the photosensitive drum 7, in a manner to reflect the latent image. As a result, the latent image is visualized as a toner image.

The toner image is transferred onto the recording medium 2 by applying to the transfer roller 4 such voltage that is opposite in polarity to the toner image. Thereafter, the peripheral surface of the photosensitive drum 7 is cleaned by cleaning means 11; the toner particles which remain on the photosensitive drum 7 are scraped off by a cleaning blade 11*a*, scooped up by a scooping sheet 11*b*, and then, collected into a waste toner container 11*c*.

The cartridge shell has an opening, which faces the interface between the photosensitive drum 7 and the transfer roller 4. The opening is covered with a drum shutter 28. This drum shutter 28 is attached to the cartridge shell with the use of a four-joint linkage system constituted of a linkage member 29, an arm member 27, and the like (FIGS. 8 and 9).

The aforementioned members such as the photosensitive drum 7 are integrally disposed in the cartridge shell, which is formed by joining a shell portion 12 which contains the toner container portion and the developing means, with a shell portion 13 which contains cleaning means. The shell portion 12 is formed by welding together a shell portion 12*a* which contains the developing means, a shell portion 12*e* which constitutes the vessel portion of the toner container portion, and a shell portion 12*c* which constitutes a cover portion of the toner container portion, at flanges 12*f*, 10*f*, and 12*d*, correspondingly.

{Structure for Installing or Removing Process Cartridge}

Next, the structure for installing the aforementioned process cartridge B into the main assembly 14 of an image forming apparatus, or removing the process cartridge B from the main assembly 14, will be described.

Referring to FIG. 5, the process cartridge B is installed or removed in the following manner. First, a lid 15 is opened by rotating it about an axis 15*a* (FIG. 2), to expose a cartridge installing means. Next, referring to FIGS. 6 and 7, there are guide rails 16, one for each lateral side of the cartridge installation space, being positioned symmetrically to each other, and slanted downward, with a slight curvature (in this embodiment, it is curved like an arc). Above each of the guide grooves 16, there is a guide member 17. The entrance side end of the guide rail 16 is connected to a second slanted surface 16*b*, and the entrance side of the second slanted surface 16*b* is connected to a first slanted surface 16*a*. The second slanted surface 16*b* is slanted more steeply than the first slanted surface 16*a*. The first slanted surface 16*a* constitutes a hooking portion with which the projection 29*b* of the linkage member 29 for opening or closing the drum shutter 28 of the process cartridge B is engaged.

On the other hand, the process cartridge B is provided with guide portions; each of the lateral walls of the process cartridge is provided with a guide portion, which projects outward in the longitudinal direction from the outward surface of the lateral wall. The left-hand and right-hand guide portions are symmetrical to each other, their locations being correspondent to the locations of the left-hand and right-hand guide rails 16, and are guided by the corresponding guide rails 16 when the process cartridge B is installed into, or removed from, the main assembly 14 of the image forming apparatus. Referring to FIG. 1, each of the guide portions of the process cartridge B integrally comprises a boss 18*a*, which constitutes the first guide portion, and a rib 18*b*, which constitutes the second guide portion The boss 18*a* is positioned on the imaginary extension of the rotational axis of the photosensitive drum 7. The rib 18*b* extends rearward, relative to the direction in which the process cartridge is inserted, from the boss 8*a*, bowing slightly downward to match the profile of the guide rail 16 (in this embodiment, its profile is substantially in the form of an arc). Referring to FIG. 8, when installing the process cartridge B, the process cartridge B is positioned so that the boss 18*a* and the rib 18*b* are placed in contact with the guide rail 16. Then, the process cartridge B is pushed into the apparatus main assembly 14, with the boss 18*a* and the rib 18*b* sliding on the rail 16, in such a manner that the leading end of the process cartridge B goes under the optical system 1. Since the guide rail 16, and the bottom wall of the guide member 17 located above the guide rail 16, are arc-shaped in profile, and the rib 18*b* is also given the arc-shaped profile, the process cartridge B becomes horizontally positioned as it is inserted more deeply Referring to FIG. 9, as the process cartridge B is farther inserted, a surface area 20, one for each of the lateral ends, which is the surface area near the leading end of the shell portion 13 for the cleaning means, comes in contact with the projection 19 of the apparatus main assembly 14. Then, the boss 18*a* of the process cartridge B drops into the recess 16*c* located at the deepest end of the guide rail 16. As the boss 18*a* drops into the recess 16*c*, an unillustrated drum gear fixed to one of the longitudinal ends of the photosensitive drum 7 engages with a driving gear 22 (FIG. 7) on the side of the apparatus main assembly 14, enabling driving force to be transmitted from the apparatus main assembly 14 to the process cartridge B. Meanwhile, the projection 29*b* of the linkage member 29 is prevented from entering more deeply into the apparatus main assembly 14, by the first and second slanted surfaces 16*a* and 16*b*, causing the shutter 28 to open.

{Filling of Toner}

Referring to FIG. 4, the shell portion 12*e* which constitutes the bottom portion of the toner container portion is provided with an opening 12*g* (FIG. 3), which is surrounded by a surface 12*k* which is recessed from the surface of the flange portion 12*f* of the shell portion 12*e*. This opening 12*g* is covered with a cover film 51, which is easily tearable in the longitudinal direction of the recessed surface 12*k*. The cover film is pasted to the recessed surface 12*k*, along all four edges of the opening 12*g*. To this cover film 51, a tear tape 52, which is used to tear open the cover film 51, that is, to unseal the opening 12*g*, is welded. The tear tape 52 is folded back at one of the longitudinal ends of the opening 12*g* (end 52*b* in the drawing), is extended all the way back, put through between the surface of the flange of the frame portion 12*e*, and an elastic seal (unillustrated) formed of felt or the like, and then, allowed to stick out of the process cartridge B. The end 52*a* of the portion of the tear tape 52, which is sticking out of the process cartridge B, is pasted to a handle 12*h*, which is integrally formed with the shell portion 12*e*. The portion which connects the shell portion 12*e* and the handle 12*h* is formed thin enough to allow the handle 12*h* to be easily separated from the shell portion 12*e*.

Figure 12:
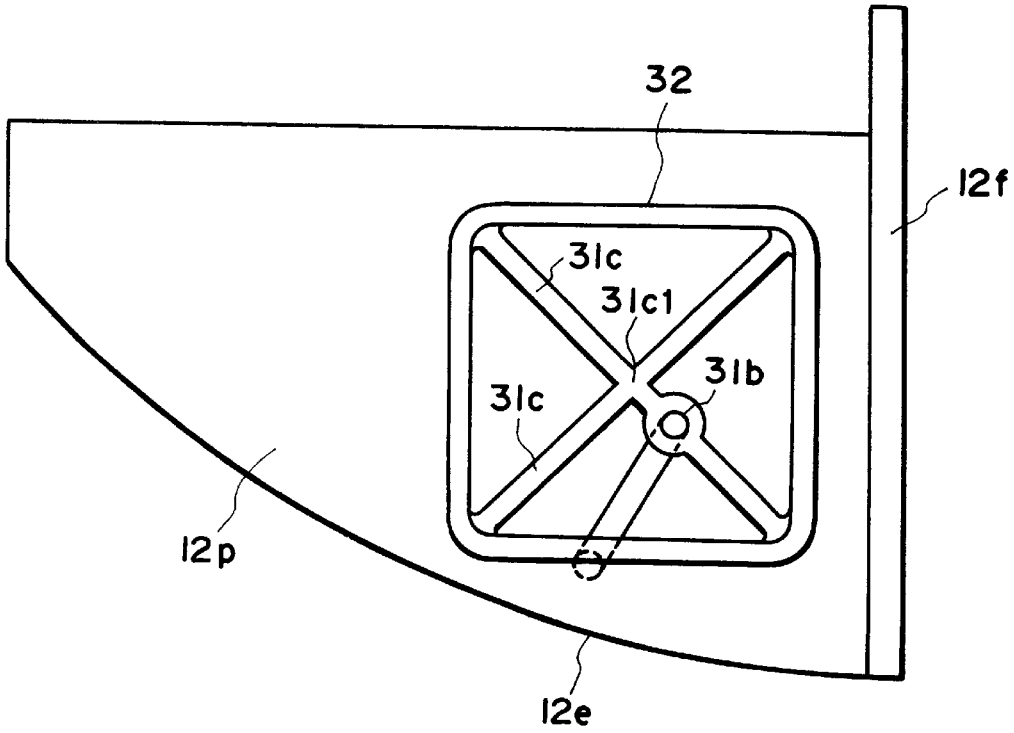
FIG. 12 is a plan view of the lateral wall of the toner container section of a process cartridge, depicting the structure of the toner filling mouth in the second embodiment of the present invention.
Figure 13:
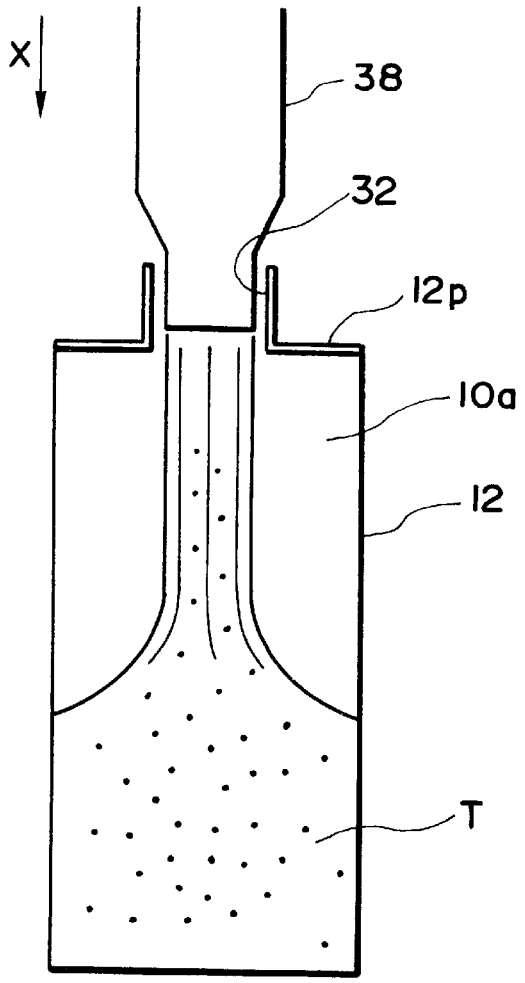
FIG. 13 is a schematic section of a toner container section of a process cartridge, depicting a method for filling a toner space with toner.

In assembling the process cartridge B, first, the shell portion 12*c* which constitutes the lid portion of the cartridge, is welded to the shell portion 12*e* which constitutes the vessel portion of the toner container portion. Next, a first toner advancing member 10*b*1 is assembled into the toner container portion 10*a*. Thereafter, the opening 12*g* of the shell portion 12*e* is sealed with the cover film 51. Then, toner is filled into the toner container portion 10*a*, which is the space surrounded by the shell portion 12*e* and the shell portion 12*c*, through the toner filling mouth 32, which will be described later (FIG. 12). Next, the top and bottom ribs of the shell portion 12*a* for the developing means are fitted into the top and bottom grooves 12*n* located at the top and bottom edges of the flange 12*f* of the shell portion 12*e*, and the top surface of the rib and the bottom surface of the groove are welded to each other with the use of ultrasonic waves.

In using the process cartridge B for the first time, the handle 12*h* must be pulled. As the handle 12*h* is pulled, the tear tape 52 is pulled out of the process cartridge B, tearing the cover film 52, and therefore exposing the opening 12*g*. As a result, the toner within the toner container portion 10*a* shifts toward the shell portion 12*a* for the developing means. Referring to FIGS. 2 and 3, during image formation, the first toner advancing member 10*b*1 is rotated clockwise by the rotation of the photosensitive drum 7, advancing, while stirring, the toner to the development roller 10*d*.

Referring to FIG. 11, the first toner advancing means 10*b*1 is constituted of a stirring rod 31*a*, a bearing 31*b* located within the opening of the toner filling mouth 32, and ribs 31*c* which extend across the opening, intersecting with each other at the substantial center of the opening, as if radially extending from the center of the opening, and therefore, equally dividing the opening.

Referring to FIG. 10, the stirring rod 31*a* is in the form of a crank, being constituted of journal portions 31*a*1 and 31*a*3, an arm portion 31*a*2, and a pin portion 31*a*4. It is formed by bending a piece of metallic wire, which is desired to be 1–4 mm, preferably, approximately 2.6 mm, in thickness. Referring to FIGS. 10 and 11, the toner filling mouth 32 is cylindrical, and is located at one of the lateral ends of the shell portion 12*e* which constitutes the vessel portion of the toner container portion It is sealed with a toner container cap 33 after the toner container portion 10*a* is filled with toner. The outward side opening of the toner filling mouth 32 is provided with ribs 31*c*, one of which is provided with the bearing 31*b*.

Next, the positional relationship among the components in the process cartridge B will be described.

FIG. 10 is a schematic vertical section of the toner container portion of the cartridge shell, parallel to the rotational axis of the first toner advancing member 10*b*1. In the drawing, a gear cover 12*j* and a side cover 12*m* are screwed to one of the longitudinal ends of the toner container shell portion 12*e*, and the other end, respectively. The inner wall of the gear cover 12*j* is provided with a bearing 12*i*, which rotatively supports a stirring rod supporting shaft which integrally comprises a gear 10*h*1 and a journal 10*h*. As described above, the first toner advancing member 10*b*1 is in the form of a crank, and one of the journal portions, that is, the journal portion 31*a*1, of the toner advancing member 10*b*1 is fitted in the center hole of the journal 10*h*. The arm portion 31*a*2 next to the journal portion 31*a*1 is fitted in a groove 10*h*2 cut in the inward surface of the journal 10*h*, radially from the center hole of the journal 10*h*. The other journal 31*a*3 of the stirring rod 31*a* of the toner advancing member 10*b*1 is supported by a bearing 31*b* integral with the inward wall of the side cover 12*m* of the toner container shell portion 12*e*.

The aforementioned gear 10*h*1 is connected, through an unillustrated gear train, to an unillustrated drum gear fixed to the photosensitive drum 7. Thus, as the photosensitive drum 7 rotates in the clockwise direction in FIGS. 2 or 3, the stirring rode 31*a* of the first toner advancing member 10*b*1 rotates in the same direction about the journals 31*a*1 and 31*a*3, and the arm portion 31*a*2 and the pin portion 31*a*4 advance, while stirring, the toner within the toner container portion 10*a* to the development roller 10*d*.

FIG. 11 shows the positioning of the bearing 31*b*, on the toner filling mouth 32 side, for supporting the stirring rod 31*a*. This bearing 31*b* is formed as a part of one of the ribs 31*c* which are integral parts of the toner container shell portion 12*e*. It is slightly off from the center of the opening of the toner filling mouth, toward the development roller 10*d*. More specifically, the center of the opening of the toner filling mouth 32 coincides with the location of the intersection 31*c*1 of the ribs 31*c* which extend across the opening of the cylindrical toner filling mouth 32, as if radially extending from the center of the opening, dividing the opening into substantial quadrants of equal size. The bearing 31*b* is positioned slightly off from this intersection 31*c*1 toward the surface of the flange 12*f*, at which the toner container shell portion 12*e* is joined with the developing means containing portion of the cartridge shell, and also diagonally downward.

In other words, the bearings 12*i* and 31*b* which support the journals 31*a*l and 31*a*3, respectively, of the stirring rode 31*a* are positioned so that the stirring rod 31*a*, the arm portions 3l*a*2 of which have been shortened to meet the goal of reducing the process cartridge size, is properly positioned. In an attempt to reduce the process cartridge size, the toner filling mouth is located in the one of the lateral walls of the toner container shell portion 12*e*, while rendering the opening of the toner filling mouth as large as possible. Further, in consideration of the shape of the lateral wall of the toner container shell portion 12*e*, the bearing 31*b* is positioned within the opening of the toner filling mouth 32. In the actual design, the ribs 31*c* are positioned so that one of the ribs 31*c* goes through the center of the opening of the toner filling mouth 32, as well as the center of the bearing 31*b*. The bearing 31*b* is integrally formed with the rib 31*c*. As described above, the ribs 31*c* are integrally formed with the toner container shell portion 12*e*. However, the ribs 31*c* and the bearing 31*b* may be separately formed from the toner container shell portion 12*e*. In such a case, they are integrally formed with a ring which perfectly fit in the opening of the toner filling mouth 32, and this ring which integrally comprises the ribs 31*c* and the bearing 31*b* is fixedly fitted in the opening of the toner filling mouth 32. The diameter of the opening of the toner filling mouth 32 is 30–40 mm, preferably, approximately 34 mm.

With the above arrangement, the stirring rod 31*a* is positioned at the best location for advancing, while stirring, the toner to the development roller 10*d*, and at the same time, the size of the opening of the toner filling mouth 32 can be increased.

In determining the position of the bearing 31*b*, the gap between the pin portion 31*a*4 and the bottom wall of the toner container shell portion 12*e* must be taken into consideration. If this gap is extremely large, the amount of the toner which fails to be advanced all the way to the development roller 10*d* and remains in the toner container shell portion 12*e*, increases. On the other hand, if this gap is designed to be extremely small, production errors or the like may cause such a problem that the pin portion 31*a*4 collides with the bottom wall of the toner container shell portion 12*e* as the arm portion 31*a*2 rotates within the toner container portion.

Also regarding the positioning of the bearing 31*b*, the positioning of the second toner advancing member 10*b*2 must be taken into consideration In other words, the bearing 31*b* must be positioned so that the first toner advancing member 10*b*1 is allowed to work in coordination with the second toner advancing member 10*b*2 to circulate the toner in a wider range. If the toner is circulated in only a small range, only the same toner particles are regulated by the development blade 10*e*, which is liable to cause such a problem that the material coated on the toner particle surface to control the amount of charge is shaved off by the friction among the toner particles.

Thus, the bearing 31*b* is desired to be properly positioned in consideration of the aforementioned plurality of factors.

At this time, referring to FIG. 11, the configuration of the lateral wall 12*p* of the toner container shell portion 12*e* will be described In FIG. 11, the length L1 of the shorter vertical edge of the lateral wall 12*p* should be 15–25 mm, desirably, approximately 20 mm, and the length L2 of the longer vertical edge of the lateral wall 12*p* should be 37–47 mm, desirably, approximately 42.5 mm. The length L3 of the horizontal top edge of the wall 12*p* should be 70–80 mm, desirably, approximately 74.7 mm. As for the bottom edge of the wall 12*p*, which comprises a straight portion and an arc portion, the radius of the arc portion should be 18–28 mm, desirably, approximately 23.1 mm, and the location of the center of the curvature of the arc portion is desired to approximately coincide with the location of the center of the bearing 31*b*. Further, the length L5 between the center of the opening of the toner filling mouth 32 and the long vertical edge should be 18–27 mm, desirably, approximately 22.3 mm. The length L4 between the center of the opening of the toner filling mouth 32 to the horizontal top edge of the wall 12*p* should be 19–29 mm, desirably, approximately 23.7 mm. The length L6 between the center of the bearing 32*b* and the long vertical edge should be 13–23 mm, desirably, approximately 17.8 mm. The length L7 between the center of the bearing 32*b* and the horizontal top edge should be 22–32 mm, desirably, approximately 26.6 mm. The diameter d1 of the bearing 31*b* should be 1–4 mm, desirably, approximately 2.6 mm.

Also referring to FIG. 11, the ribs 31*c* are disposed across the opening portion of the toner filling mouth 32 as if radially extending from the center of the opening toward the edge of the opening, and divide the opening into quadrants In filling toner, the process cartridge B is caused to stand on the lateral wall opposite to the lateral wall with the toner filling mouth 32, that is, it is positioned so that the longitudinal direction of the shell portion 12 which contains the toner and the developing means becomes vertical, and then, the toner is filled into the toner container space 10*a* through the toner filling mouth 32 by allowing the toner to fall into the space 10*a*. Since the ribs 31*c* are disposed, as if radially extending from the center of the opening of the toner filling mouth 32, and divide the opening into quadrants, none of the gaps between the adjacent two ribs 31*c* is reduced in size, and therefore, the toner can be easily filled.

In this embodiment, two ribs 31*c* are disposed across the opening, in a manner to perpendicularly cross each other at the center of the opening. However, one of the ribs 31*c*, which does not integrally comprise the bearing 31*b*, does not need to be present. In other words, the number of ribs 31*c* which are placed across the center of the opening of the toner filling mouth 32 may be only one.

Referring to FIG. 12, in filling toner into the toner container space 10*a*, the shell portion 12 which contains the toner and the developing means, that is, the cartridge sheet portion which is formed by welding the shell portion 12*c* which constitutes the lid portion of the toner container portion, to the toner container shell portion 12*e* which constitutes the vessel portion of the toner container portion, is caused to stand in such a manner that the longitudinal direction of the cartridge shell becomes vertical, and then, a predetermined amount of toner T is filled into the toner space 10*a* by a toner filling apparatus 38 through the toner filling mouth 32.

Embodiment 2

In Embodiment 1 described above, the toner filling mouth 32 was cylindrical, but it may have a square cross section as illustrated in FIG. 12. In such a case, the ribs 31*c* are diagonally placed across the square opening of the toner filling mouth 32 in a manner to perpendicularly cross each other at a point 31*c*1, and the bearing 31*b* for supporting the stirring rod 31*a* is positioned slightly off from the cross section 31*c*1 toward the flange 12*f*. Further, the toner filling mouth may be shaped so that its cross section becomes triangular or semicircular. When the cross section of the toner filling mouth 32 is triangular or semicircular, the bearing 32*b* is farther off from the center of the opening toward the development roller 10*d*.

Embodiment 3

In Embodiment 1 described above, the stirring rod bearing 32*b* which supports the stirring rod 31*a* is located within the opening of the toner filling mouth 32. In this embodiment, not only is the stirring rod bearing 32*b* positioned within the opening of the toner filling mouth 32, but also a member for driving the stirring rod 31*a* is positioned within the opening.

Figure 14:
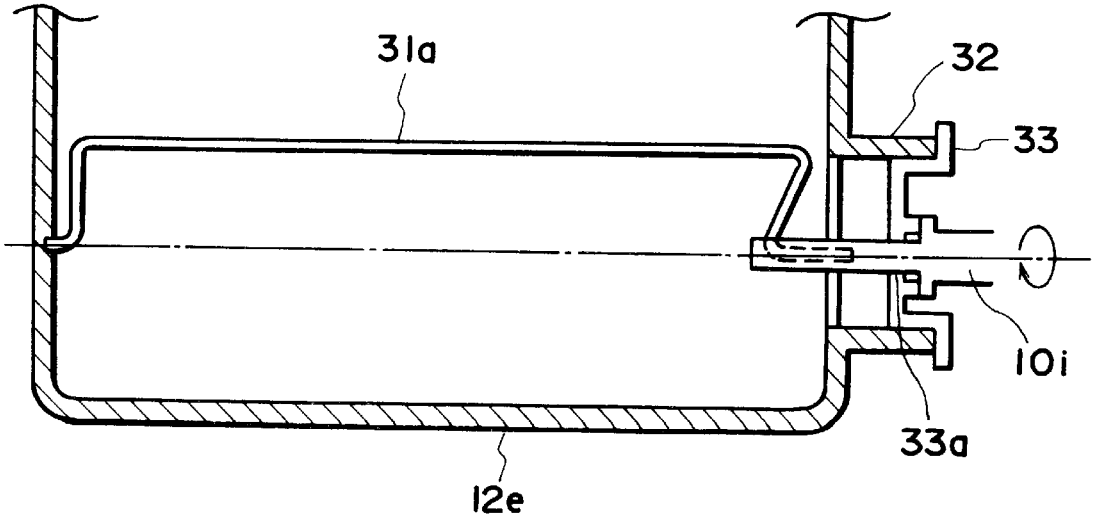
FIG. 14 is a vertical section of the toner container section of a process cartridge in the third embodiment of the present invention, parallel to the longitudinal direction of the process cartridge.

Referring to FIG. 14, in this Embodiment 3, one end of the stirring rod 31*a* is rotatively supported simply by the lateral wall of the toner container shell portion 12*e*, and the other end of the stirring rod 31*a* is fitted in, being thereby supported by, a stirring rod supporting shaft 10*i*. The shaft 10*i* is rotatively supported by a bearing 33*a* integral with a toner container cap 33, which is removably press-fitted in the toner filling mouth 32 (engagement between the stirring rod 31*a* and the stirring rod supporting shaft 10*i* is the same as in Embodiment 1).

The stirring rod bearing 33*a* is off from the center of the opening of the toner filling mouth 32 toward the development roller 10*d*, as well as toward the bottom wall of the toner container shell portion 12*e*. With this arrangement, the size of the toner filling mouth 32 can be increased to a size necessary for efficiently filling the toner space 10*a* with toner.

In this Embodiment 3, there is no rib 31*c* in the toner filling mouth 32, and therefore, it is that much easier to fill toner into the toner space 10*a*.

Further, the positioning of the stirring rod bearing 32*b* may be such that the rib(s) 31*c* and the stirring rod bearing 32*b* are integrally formed with the toner container shell portion 12*e* to support the stirring rod 31*a* in the same manner as described in the preceding embodiments, and the stirring rod supporting shaft 10*i* is supported by the bearing 33*a*, which is integrally formed with the toner container cap 33, and located at a point where the extension of the stirring rod journal 31*a*3 meets the toner container cap (this arrangement is unillustrated).

Other Embodiments

In the preceding embodiments, the bearing 31*b* is located between the longitudinal ends of one of the ribs 31*c*, but the positioning of the bearing 31*b* does not need to be limited to those described in the preceding embodiments. For example, the positioning of the bearing 31*b* may be such that a rib is extended from the circular edge of the opening of the toner filling mouth, toward the center of the opening, and the bearing 31*b* is located at the tip of the thus extended rib.

In summary, according to the present invention, there is provided a toner frame (e.g. 12*e*) usable with a main assembly of an electrophotographic image forming apparatus (e.g. A), comprising:

(a) a toner containing portion (e.g. 10*a*) for containing toner to be supplied to a developing member (e.g. 10*d*) for developing a latent image formed on an electrophotographic photosensitive member (e.g. 7);

(b) a toner supply opening (e.g. 32) for supplying the toner into said toner containing portion, wherein said toner supply opening is provided in a longitudinal end portion (e.g. 12*p*) of said toner containing portion; and (c) a supporting portion (e.g. 31*b*) for supporting one end portion of a stirring member (e.g. 31*a*) for stirring toner contained in said toner containing portion, wherein said supporting portion is disposed within a range of said toner supply opening and at a position deviated from a center of said toner supply opening, as seen in a longitudinal direction of said toner frame.

The toner frame may comprise a first rib (eg. 31*c*) bridging said opening, and said supporting portion is provided in said first rib.

The toner frame may comprise a second rib (e.g. 31*c*) bridging said opening in a direction crossing with said first rib.

The toner frame may comprise said first and second ribs crossed with each other at the center of said opening.

In the toner frame, said toner containing portion, said supporting portion, said first rib and said second rib are of integrally formed plastic material.

In the toner frame, said toner supply opening is circular.

In the toner frame, said toner containing portion is provided with toner discharge opening (e.g. 12*g*) through which the toner is supplied out of said toner containing portion toward said developing member, and said supporting portion is provided at the position deviated from the center toward said toner discharge opening.

In the toner frame, said range contains a longitudinal extension of said toner supply opening.

In the toner frame, a second opening (e.g. 12*i*) is provided in a longitudinal end portion opposite from said longitudinal end portion having said toner supply opening and is capable of supporting the other end portion of said stirring member.

In the toner frame, a center of said supporting portion is deviated approx. 2–10 mm from the center of said toner supply opening.

In the toner frame, said stirring member including, at it central part, an arm portion (31*a*2) extending in a radial direction of its rotation.

As is evident from the preceding embodiments described above, the present invention makes it possible to provide a toner container shell portion, and a process cartridge, in which the supporting portion for the toner stirring member, and the toner filling mouth, are properly positioned.

Further, the present invention makes it possible to provide a toner container shell portion, and a process cartridge, in which the supporting portion for the toner stirring member is properly positioned even though the toner container shell portion is provided with a toner filling mouth with desirable toner filling efficiency.

While the invention has been described with reference to the structures disclosed herein, it is not confined to the details set forth, and this application is intended to cover such modifications or changes as may come within the purposes of the improvements or the scope of the following claims.

What is claimed is:

1. A toner frame usable with a main assembly of an electrophotographic image forming apparatus, comprising:

(a) a toner containing portion for containing toner to be supplied to a developing member for developing a latent image formed on an electrophotographic photosensitive member;

(b) a toner supply opening for supplying the toner into said toner containing portion, wherein said toner supply opening is provided in a longitudinal end portion of said toner containing portion; and (c) a supporting portion for supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame.

2. A toner frame according to claim 1, further comprising a first rib bridging said opening, and said supporting portion is provided in said first rib.

3. A toner frame according to claim 2, further comprising a second rib bridging said opening in a direction crossing with said first rib.

4. A toner frame according to claim 3, further comprising said first and second ribs crossed with each other at the center of said opening.

5. A toner frame according to claim 4, wherein said toner containing portion, said supporting portion, said first rib and said second rib are of integrally formed plastic material.

6. A toner frame according to claim 1, wherein said toner supply opening is circular.

7. A toner frame according to claim 1, wherein said toner containing portion is provided with toner discharge opening through which the toner is supplied out of said toner containing portion toward said developing member, and said supporting portion is provided at the position deviated from the center toward said toner discharge opening.

8. A toner frame according to claim 1, wherein said range contains a longitudinal extension of said toner supply opening.

9. A toner frame according to claim 1, wherein a second opening is provided in a longitudinal end portion opposite from said longitudinal end portion having said toner supply opening and is capable of supporting the other end portion of said stirring member.

10. A toner frame according to claim 1, wherein a center of said supporting portion is deviated approx. 2–10 mm from the center of said toner supply opening.

11. A toner frame according to claim 1, wherein said stirring member including, at it central part, an arm portion extending in a radial direction of its rotation.

12. A process cartridge detachably mountable relative to a main assembly of an image forming apparatus, comprising:

(a) an electrophotographic photosensitive member;

(b) a developing member for developing a latent image formed on said electrophotographic photosensitive member;

(c) a toner frame including:

a toner containing portion for containing toner to be supplied to said developing member;

a toner supply opening for supplying the toner into said toner containing portion, wherein said toner supply opening is provided in a longitudinal end portion of said toner containing portion; and a supporting portion supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame.

13. A process cartridge according to claim 12, further comprising a first rib bridging said opening, and said supporting portion is provided in said first rib.

14. A process cartridge according to claim 13, further comprising a second rib bridging said opening in a direction crossing with said first rib.

15. A process cartridge according to claim 14, further comprising said first and second ribs crossed with each other at the center of said opening.

16. A process cartridge according to claim 15, wherein said toner containing portion, said supporting portion, said first rib and said second rib are of integrally formed plastic material.

17. A process cartridge according to claim 12, wherein said toner supply opening is circular.

18. A process cartridge according to claim 12, wherein said toner containing portion is provided with toner discharge opening through which the toner is supplied out of said toner containing portion toward said developing member, and said supporting portion is provided at the position deviated from the center toward said toner discharge opening.

19. A process cartridge according to claim 12, wherein said range contains a longitudinal extension of said toner supply opening.

20. A process cartridge according to claim 12, wherein a second opening is provided in a longitudinal end portion opposite from said longitudinal end portion having said toner supply opening and is capable of supporting the other end portion of said stirring member.

21. A process cartridge according to claim 12, wherein a center of said supporting portion is deviated approx. 2–10 mm from the center of said toner supply opening.

22. A process cartridge according to claim 12, wherein said stirring member including, at it central part, an arm portion extending in a radial direction of its rotation.

23. A process cartridge detachably mountable relative to a main assembly of an image forming apparatus, comprising:

(a) an electrophotographic photosensitive member;

(b) a developing member for developing a latent image formed on said electrophotographic photosensitive member;

(c) a toner frame including:

a toner containing portion for containing toner to be supplied to said developing member;

a toner supply opening for supplying the toner into said toner containing portion, wherein said toner supply opening is provided in a longitudinal end portion of said toner containing portion;

a removable sealing member for sealing said toner supply opening, said sealing member supporting one end portion of a stirring member for stirring toner contained in said toner containing portion, at a position which is within a range of said toner supply opening and is deviated from a center of said toner supply opening, as seen in a longitudinal direction of said toner frame.

24. A process cartridge according to claim 23, further comprising a feeding member which further stirs and feeds the toner stirred and fed by said stirring member.

25. A process cartridge according to claim 12 or 23, further comprising at least one of a charging member for charging said electrophotographic photosensitive member and a cleaning member for removing residual toner from said photosensitive member.

26. An electrophotographic image forming apparatus for forming an image on a recording material, comprising:

mounting means for detachably mounting the process cartridge, said process cartridge including:

(a) an electrophotographic photosensitive member;

(b) a developing member for developing a latent image formed on said electrophotographic photosensitive member;

(c) a toner frame including:

a toner containing portion for containing toner to be supplied to said developing member;

a toner supply opening for supplying the toner into said toner containing portion, wherein said toner supply opening is provided in a longitudinal end portion of said toner containing portion; and a supporting portion supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame; and (d) feeding means for feeding the recording material.

* * * * *

UNITED STATES PATENT AND TRADEMARK OFFICE

CERTIFICATE OF CORRECTION

PATENT NO. : 5,940,658
DATED : August 17, 1999
INVENTOR(S) : Akiyoshi Yokoi et al.

It is certified that error appears in the above-identified patent and that said Letters Patent is hereby corrected as shown below:

Column 1,
Line 7, "A" should read -- The term --; and "means" should read -- refers to --;
Line 19, "An" should read -- The term --; and "means" should read -- refers to --,
Line 25, "the" should be deleted;
Line 27, "apparatuses" should read -- apparatuses, --;
Line 29, "ers" should read -- ers, --;
Line 33, "medium" should read -- medium, --;
Line 40, "A" should read -- The term --;
Line 41, "means" should read -- refers to --;
Line 42, "means" should read --means, --;
Line 47, "likes." should read -- like. --;
Line 50, "cartridge" should read -- cartridge, --; and
Line 52, "is filled" should read -- passes --.

Column 2,
Line 23, "said" (both occurrences) should read -- the --; and
Lines 25, 27, 28, 29, 30 and 32, "said" should read -- the --;

Column 4,
Line 16, "of" should read -- by --;
Line 47, "disposed the" should read -- disposed. The --; and
Line 52, "particles The" should read -- particles. The --.

Column 5,
Line 4, "members" should read -- members, --;
Line 5, "drum 7" should read -- drum 7, --;
Line 9, "portion 12a" should read -- portion 12a, --;
Line 25, "symmetrically" should read -- symmetrically with respect --;
Line 43, “symmetrical” should read -- symmetrical with respect --;
Line 44, "being correspondent" should read -- corresponding --;
Line 51, "portion The" should read -- portion. The --; and
Line 57, "the arc-shaped" should read -- an arc-shaped --.

Column 6,
Line 2, "deeply Referring" should read -- deeply. Referring --;
Line 3, "farther inserted," should read -- inserted farther, --;
Line 12, "driving" should read -- a driving --;
Line 42, "portion 12*c*" should read -- portion 12*c*, --; and
Line 43, "portion 12*e*" should read -- portion 12*e*, --.

UNITED STATES PATENT AND TRADEMARK OFFICE

CERTIFICATE OF CORRECTION

PATENT NO. : 5,940,658
DATED : August 17, 1999
INVENTOR(S) : Akiyoshi Yokoi et al.

It is certified that error appears in the above-identified patent and that said Letters Patent is hereby corrected as shown below:

Column 7,
Line 16, "portion It" should read -- portion. It --.

Column 8,
Line 26, "preferably," should read -- and preferably, --;
Line 45, "consideration In" should read -- consideration. In --;
Line 59, "described In" should read -- described. In --; and
Line 65, "desirably," should read -- and desirably, --.

Column 9,
Lines 1, 6, 9, 11 and 14, "desirably," should read -- and desirably, --;
Line 20, "quadrants" should read -- quadrants. --; and
Line 41, "portion 12*c*" should read -- portion 12*c*, --.

Column 10,
Lines 55, 60 and 66, "said" (both occurrences) should read -- the --; and
Lines 57, 61, 63 and 64, "said" should read -- the --;

Column 11,
Lines 2, 6, 7 and 13, "said" (both occurrences) should read -- the --; and
Lines 4, 5, 9, 10, 12, 15, 16, 17, 19, 20, 21, 22 and 23, "said" should read -- the --;

Column 11, lines 45 through Column 14, line 35,
Claims 1-26 should be deleted and substituted with the following claims 1-26:

--1. A toner frame usable with a main assembly of an electrophotographic image forming apparatus, comprising:

(a) a toner containing portion for containing toner to be supplied to a developing member for developing a latent image formed on an electrophotographic photosensitive member;

(b) a toner supply opening for supplying the toner into said toner containing portion, wherein said toner supply opening is provided in a longitudinal end portion of said toner containing portion; and (c) a supporting portion for supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame.

2. A toner frame according to Claim 1, further comprising a first rib bridging said toner supply opening, and wherein said supporting portion is provided in said first rib.

CERTIFICATE OF CORRECTION

PATENT NO. : 5,940,658
DATED : August 17, 1999
INVENTOR(S) : Akiyoshi Yokoi et al.

It is certified that error appears in the above-identified patent and that said Letters Patent is hereby corrected as shown below:

Columns 11-14 (cont'd),

3. A toner frame according to Claim 2, further comprising a second rib bridging said toner supply opening in a direction crossing with said first rib.

4. A toner frame according to Claim 3, wherein said first and second ribs cross with each other at the center of said toner supply opening.

5. A toner frame according to Claim 4, wherein said toner containing portion, said supporting portion, said first rib and said second rib are of integrally formed plastic material.

6. A toner frame according to Claim 1, wherein said toner supply opening is circular.

7. A toner frame according to Claim 1, wherein said toner containing portion is provided with a toner discharge opening through which the toner passes out of said toner containing portion toward said developing member, and wherein said supporting portion is provided at a position deviated from the center of said toner supply opening toward said toner discharge opening.

8. A toner frame according to Claim 1, wherein said range contains a longitudinal extension of said toner supply opening.

9. A toner frame according to Claim 1, wherein a second opening is provided in a longitudinal end portion of said toner containing portion opposite from said longitudinal end portion having said toner supply opening and is capable of supporting the other end portion of said stirring member.

10. A toner frame according to Claim 1, wherein a center of said supporting portion is deviated approximately 2-10mm from the center of said toner supply opening.

11. A toner frame according to Claim 1, wherein said stirring member includes, at it central part, an arm portion extending in a radial direction of its rotation.

12. A process cartridge detachably mountable relative to a main assembly of an image forming apparatus, comprising:

(a) an electrophotographic photosensitive member;

(b) a developing member for developing a latent image formed on said electrophotographic photosensitive member;

(c) a toner frame including:

It is certified that error appears in the above-identified patent and that said Letters Patent is hereby corrected as shown below:

Columns 11-14 (cont'd), a toner containing portion for containing toner to be supplied to said developing member;

a toner supply opening for supplying the toner into said toner containing portion, wherein said toner supply opening is provided in a longitudinal end portion of said toner containing portion; and a supporting portion supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame.

13. A process cartridge according to Claim 12, further comprising a first rib bridging said toner supply opening, and wherein said supporting portion is provided in said first rib.

14. A process cartridge according to Claim 13, further comprising a second rib bridging said toner supply opening in a direction crossing with said first rib.

15. A process cartridge according to Claim 14, wherein said first and second ribs cross with each other at the center of said toner supply opening.

16. A process cartridge according to Claim 15, wherein said toner containing portion, said supporting portion, said first rib and said second rib are of integrally formed plastic material.

17. A process cartridge according to Claim 12, wherein said toner supply opening is circular.

18. A process cartridge according to Claim 12, wherein said toner containing portion is provided with a toner discharge opening through which the toner passes out of said toner containing portion toward said developing member, and wherein said supporting portion is provided at a position deviated from the center of said toner supply opening toward said toner discharge opening.

19. A process cartridge according to Claim 12, wherein said range contains a longitudinal extension of said toner supply opening.

20. A process cartridge according to Claim 12, wherein a second opening is provided in a longitudinal end portion of said toner containing portion opposite from said longitudinal end portion having said toner supply opening and is capable of supporting the other end portion of said stirring member.

It is certified that error appears in the above-identified patent and that said Letters Patent is hereby corrected as shown below:

Columns 11-14 (cont'd),

21. A process cartridge according to Claim 12, wherein a center of said supporting portion is deviated approximately 2-10mm from the center of said toner supply opening.

22. A process cartridge according to Claim 12, wherein said stirring member includes, at it central part, an arm portion extending in a radial direction of its rotation.

23. A process cartridge detachably mountable relative to a main assembly of an image forming apparatus, comprising:

(a) an electrophotographic photosensitive member;

(b) a developing member for developing a latent image formed on said electrophotographic photosensitive member;

(c) a toner frame including:

a toner containing portion for containing toner to be supplied to said developing member;

a toner supply opening for supplying the toner into said toner containing portion, wherein said toner supply opening is provided in a longitudinal end portion of said toner containing portion;

a removable sealing member for sealing said toner supply opening, said sealing member supporting one end portion of a stirring member for stirring toner contained in said toner containing portion, at a position which is within a range of said toner supply opening and is deviated from a center of said toner supply opening, as seen in a longitudinal direction of said toner frame.

24. A process cartridge according to Claim 23, further comprising a feeding member which further stirs and feeds the toner stirred and fed by said stirring member.

25. A process cartridge according to Claim 12 or 23, further comprising at least one of a charging member for charging said electrophotographic photosensitive member and a cleaning member for removing residual toner from said photosensitive member.

26. An electrophotographic image forming apparatus for forming an image on a recording material, comprising:

mounting means for detachably mounting the process cartridge, said process cartridge including:

UNITED STATES PATENT AND TRADEMARK OFFICE

CERTIFICATE OF CORRECTION

PATENT NO. : 5,940,658
DATED : August 17, 1999
INVENTOR(S) : Akiyoshi Yokoi et al.

It is certified that error appears in the above-identified patent and that said Letters Patent is hereby corrected as shown below:

Columns 11-14 (cont'd), (a) an electrophotographic photosensitive member;

(b) a developing member for developing a latent image formed on said electrophotographic photosensitive member;

(c) a toner frame including:

a toner containing portion for containing toner to be supplied to said developing member;

a toner supply opening for supplying the toner into said toner containing portion, wherein said toner supply opening is provided in a longitudinal end portion of said toner containing portion; and a supporting portion supporting one end portion of a stirring member for stirring toner contained in said toner containing portion, wherein said supporting portion is disposed within a range of said toner supply opening and at a position deviated from a center of said toner supply opening, as seen in a longitudinal direction of said toner frame; and (d) feeding means for feeding the recording material.--

Signed and Sealed this

Twenty-first Day of June, 2005

JON W. DUDAS
*Director of the United States Patent and Trademark Office*